US008723898B2

(12) United States Patent
Aiba

(10) Patent No.: US 8,723,898 B2
(45) Date of Patent: May 13, 2014

(54) IMAGE PROCESSING APPARATUS, IMAGE PROCESSING METHOD, IMAGE DISPLAY APPARATUS, AND IMAGE DISPLAY METHOD

(75) Inventor: Hideki Aiba, Moriya (JP)

(73) Assignee: JVC Kenwood Corporation, Yokohama-Shi, Kanagawa (JP)

( * ) Notice: Subject to any disclaimer, the term of this patent is extended or adjusted under 35 U.S.C. 154(b) by 154 days.

(21) Appl. No.: 13/416,396

(22) Filed: Mar. 9, 2012

(65) Prior Publication Data

US 2012/0229527 A1 Sep. 13, 2012

(30) Foreign Application Priority Data

Mar. 11, 2011 (JP) ..... P2011-054035
Mar. 1, 2012 (JP) ..... P2012-044978

(51) Int. Cl.
*G09G 5/10* (2006.01)

(52) U.S. Cl.
USPC ..... 345/690; 345/102

(58) Field of Classification Search
USPC ..... 345/98, 102, 690, 691
See application file for complete search history.

(56) References Cited

U.S. PATENT DOCUMENTS

2006/0114265 A1* 6/2006 Nishida ..... 345/593
2006/0267904 A1* 11/2006 Aiba ..... 345/98
2007/0247391 A1* 10/2007 Someya et al. ..... 345/7
2011/0050739 A1* 3/2011 Namioka ..... 345/690

FOREIGN PATENT DOCUMENTS

JP 2006-154064 A 6/2006
JP 2006-337448 A 12/2006

* cited by examiner

*Primary Examiner* — Latanya Bibbins
(74) *Attorney, Agent, or Firm* — Nath, Goldberg & Meyer; Jerald L. Meyer; Stanley N. Protigal

(57) ABSTRACT

A brightness detection unit detects brightness. An interpolation image signal generation unit generates interpolation image signal which are to be interpolated between each two adjacent frames of an input image signal. A temporal emphasis unit emphasizes high temporal frequency components of the input image signal and interpolation image signal. A time-series conversion memory converts the frame frequency of the image signal with the high temporal frequency components emphasized. A temporal emphasis unit adjusts amplitudes of a pair of inputted image signals according to the image brightness and determines a gain coefficient based on the pair of image signals with the amplitudes adjusted, the gain coefficient indicating the degree to which the high temporal frequency components are to be emphasized.

8 Claims, 3 Drawing Sheets

IMAGE PROCESSING APPARATUS, IMAGE PROCESSING METHOD, IMAGE DISPLAY APPARATUS, AND IMAGE DISPLAY METHOD

CROSS REFERENCE TO RELATED APPLICATION

This invention is based upon and claims the benefit of priority under 35 U.S.C. §119 to Japanese Patent Applications No. P2011-054035, filed on Mar. 11, 2011 and No. P2012-044978, filed on Mar. 1, 2012, the entire contents of which are incorporated herein by reference.

BACKGROUND OF THE INVENTION

The present invention relates to an image processing apparatus, an image processing method, an image display apparatus, and an image display method for displaying an image on a liquid crystal panel.

Conventionally-known techniques to display an image on a liquid crystal display are described in Japanese Patent Laid-open Publication No. 2006-337448 (PTL1), Japanese Patent Laid-open Publication No. 2006-154064 (PTL2), and the like.

PTL1 describes an image display apparatus with less motion picture blurring. This image display apparatus detects motion vectors from an image signal and an image signal delayed by one frame and uses the motion vectors to generate an interpolation image signal which is to be interpolated between frames. This image display apparatus performs temporal emphasis for the image signal and the interpolation image signal using the image signals of the previous frames, writes the temporally emphasized image signal and interpolation image signal in a memory, and then alternately reads the written image signal and interpolation image signal from the memory at twice the writing frequency. The image display apparatus thus obtains an output image signal having the doubled frame frequency.

PTL2 describes a display method achieving reduction in power consumption. This display method adjusts the transmittance of a liquid crystal panel (pixel brightness) and the brightness of the backlight based on average brightness of an image signal and the like.

SUMMARY OF THE INVENTION

In order to reduce motion picture blurring of an image signal and reduce the power consumption of the backlight, both techniques described in PTL1 and PTL2 may be combined in an image display apparatus. However, it has been revealed that just combining the techniques described in PTL1 and PTL2 cannot effectively reduce motion picture blurring of image signals.

Accordingly, the present invention was proposed in the light of the aforementioned circumstances, and an object of the present invention is to provide an image processing apparatus, an image processing method, an image display apparatus, and an image display method capable of effectively reducing motion picture blurring of an image signal.

In order to solve the aforementioned conventional technical problem, a first aspect of the present invention provides an image processing apparatus including: a brightness detection unit configured to detect image brightness; a delay unit configured to delay a first image signal having a first frame frequency by one frame to generate a second image signal; an interpolation image signal generation unit which configured to, by using the first and second image signals, generate first to (n−1)-th interpolation image signals which are to be interpolated between adjacent two frames of the first image signal for providing a frame frequency n-times higher than the first frame frequency (n is an integer not less than 2); a temporal emphasis unit configured to emphasize a high temporal frequency component of the first image signal using a pair of image signals of the first image signal and the first interpolation image signal, emphasize a high temporal frequency component of the i-th one of the first to (n−2)-th interpolation image signals using a pair of image signals of the i-th interpolation image signal and the (i+1)-th interpolation image signal (i is an integer not less than 1 and not more than n−2), and emphasize the high temporal frequency component of the (n−1)-th interpolation image signal using a pair of image signals of the (n−1)-th interpolation image signal and the second image signal; and a memory into which the first image signal and the first to (n−1)-th interpolation image signals with the high temporal frequency component emphasized by the temporal emphasis unit are written and from which the written the first image signal and the first to (n−1)-th interpolation image signals are read at a second frame frequency which is equal to n times the first frame frequency. In the image processing apparatus, the temporal emphasis unit includes: a first gain controller configured to adjust amplitudes of each of the pairs of image signals according to the image brightness detected by the brightness detection unit; a gain coefficient determination unit configured to determine a gain coefficient based on each of the pairs of image signals with the amplitudes adjusted by the first gain controller, the gain coefficient indicating a degree to which the high temporal frequency components of the first image signal and the first to (n−1)-th interpolation image signals are to be emphasized; and a high temporal frequency component generation unit configured to use the gain coefficient determined by the gain coefficient determination unit to generate the high temporal frequency components which are to be individually added to the first image signal and the first to (n−1)-th interpolation image signals.

A second aspect of the present invention provides an image processing method including the steps of: detecting image brightness; delaying a first image signal having a first frame frequency by one frame to generate a second image signal; by using the first and second image signals, generating first to (n−1)-th interpolation image signals which are to be interpolated between adjacent two frames of the first image signal for providing a frame frequency n times higher than the first frame frequency (n is an integer not less than 2); emphasizing a high temporal frequency component of the first image signal using a pair of image signals of the first image signal and the first interpolation image signal, emphasizing a high temporal frequency component of the i-th one of the first to (n−2)-th interpolation image signals using a pair of image signals of the i-th interpolation image signal and the (i+1)-th interpolation image signal (i is an integer not less than 1 and not more than n−2), and emphasizing the high temporal frequency component of the (n−1)-th interpolation image signal using a pair of image signals of the (n−1)-th interpolation image signal and the second image signal; and writing in a memory, the first image signal and the first to (n−1)-th interpolation image signals with the high temporal frequency component emphasized and reading from the memory, the written the first image signal and the first to (n−1)-th interpolation image signals at a second frame frequency which is equal to n times the first frame frequency. In the step of emphasizing the high temporal frequency components of the first image signal and the first to (n−1)-th interpolation image signals, the image processing method includes the steps of adjusting amplitudes of each pair of image signals according to the detected image brightness; determining a gain coefficient based on the pair of image signals with the amplitudes adjusted, the gain coefficient indicating a degree to which the high temporal frequency components of the first image signal and the first to (n−1)-th interpolation image signals are to be emphasized, and by using the determined gain coefficient, generating the high temporal frequency components which are to be individually added to the first image signal and the first to (n−1)-th interpolation image signals.

A third aspect of the present invention provides an image display apparatus including: the aforementioned image processing apparatus; a liquid crystal display; and a backlight projecting light onto the liquid crystal panel.

A fourth aspect of the present invention provides an image display method including the steps of: detecting image brightness; delaying a first image signal having a first frame frequency by one frame to generate a second image signal; by using the first and second image signals, generating first to (n−1)-th interpolation image signals which are to be interpolated between adjacent two frames of the first image signal for providing a frame frequency n times higher than the first frame frequency (n is an integer not less than 2); emphasizing a high temporal frequency component of the first image signal using a pair of image signals of the first image signal and the first interpolation image signal, emphasizing a high temporal frequency component of the i-th one of the first to (n−2)-th interpolation image signals using a pair of image signals of the i-th interpolation image signal and the (i+1)-th interpolation image signal (i is an integer not less than 1 and not more than n−2), and emphasizing the high temporal frequency component of the (n−1)-th interpolation image signal using a pair of image signals of the (n−1)-th interpolation image signal and the second image signal; writing in a memory, the first image signal and the first to (n−1)-th interpolation image signals with the high temporal frequency component emphasized and reading from the memory, the written the first image signal and the first to (n−1)-th interpolation image signals at a second frame frequency which is equal to n times the first frame frequency; adjusting an amplitude of the image signal which is read from the memory and has the second frame frequency according to the detected image brightness; displaying the image signal having the second frame frequency and the adjusted amplitude on a liquid crystal panel; and for projecting light emitted from a backlight onto the liquid crystal panel, adjusting intensity of the light from the backlight according to the detected image brightness to cancel the adjustment of the amplitude of the image signal having the second frame frequency. In the step of emphasizing the high temporal frequency components of the first image signal and the first to (n−1)-th interpolation image signals, the image processing method includes the steps of adjusting amplitudes of each pair of image signals according to the detected image brightness; determining a gain coefficient based on the pair of image signals with the amplitudes adjusted, the gain coefficient indicating the degree to which the high temporal frequency components of the first image signal and the first to (n−1)-th interpolation image signals are to be emphasized, and generating high temporal frequency components which are to be individually added to the first image signal and the first to (n−1)-th interpolation image signals using the determined gain coefficient.

BRIEF DESCIPTION OF THE DRAWINGS

DESCRIPTION OF THE EMBODIMENTS

Hereinafter, a description is given of embodiments of an image processing apparatus, an image processing method, an image display apparatus, and an image display method of the present invention.

First Embodiment

Figure 1:
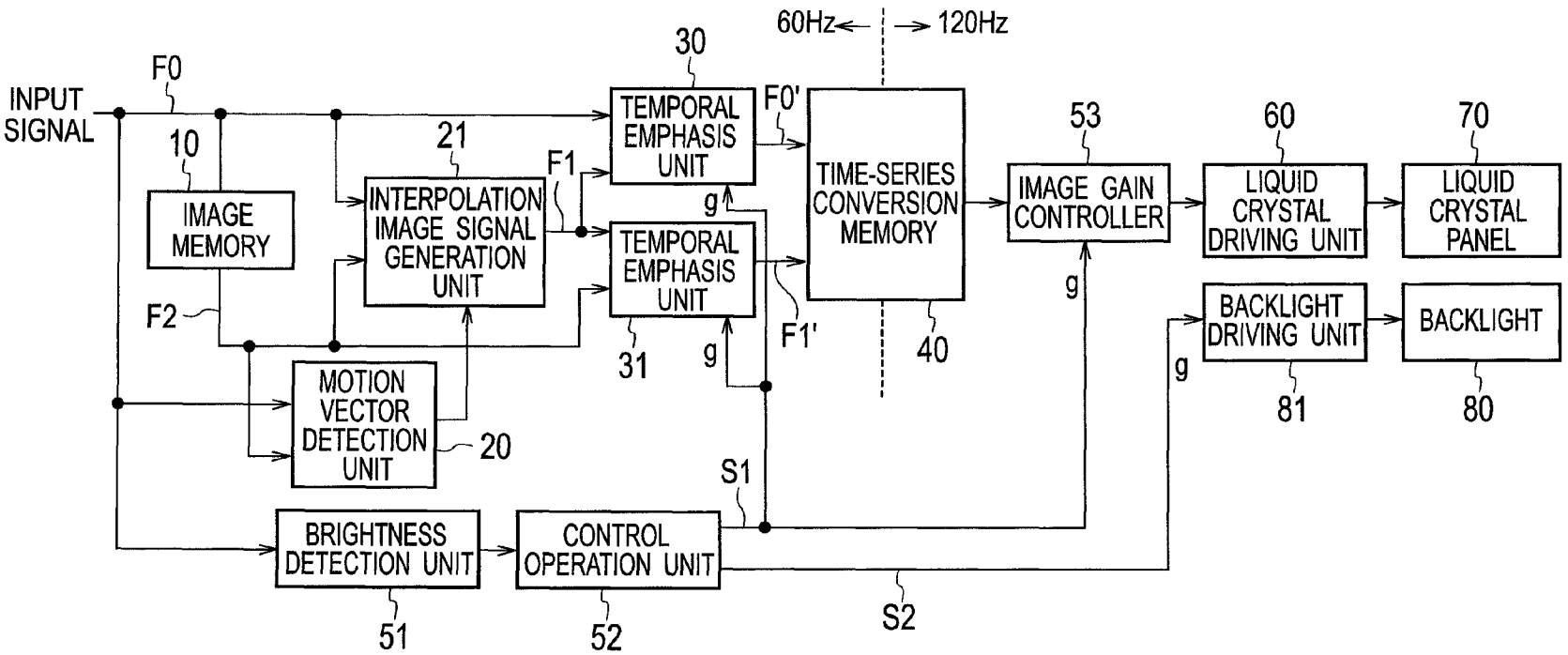
FIG. 1 is a block diagram showing a first embodiment of an image display apparatus of the present invention.

An image display apparatus of a first embodiment is configured as shown in FIG. 1, for example.

In FIG. 1, an input image signal F0 (a first image signal) having a first frame frequency is supplied to an image memory 10, a motion vector detection unit 20, an interpolation image signal generation unit 21, a temporal emphasis unit 30, and a brightness detection unit 51. The image memory 10 delays the input image signal F0 by one frame to generate an image signal F2 delayed by one frame (a second image signal). The image signal F2 is supplied to the motion vector detection unit 20, interpolation image signal generation unit 21, and a temporal emphasis unit 31. The image memory 10 functions as a delay unit delaying the input image signal F0 by one frame to generate the image signal F2 (second image signal).

The motion vector detection unit 20 detects motion vectors between frames based on the input image signal F0 and the videos signal F2. The motion vector detection unit 20 detects the motion vectors using a matching method, for example. The motion vectors detected by the motion vector detection unit 20 are supplied to the interpolation image signal generation unit 21.

The interpolation image signal generation unit 21 generates the interpolation image signal F1 from the input image signal F0 and the image signal F2 based on the motion vectors supplied from the motion vector detection unit 20. The interpolation image signal F1 is an image signal which is to be interpolated between adjacent two frames of the image signal having a frame frequency not yet increased, where the image signal is not present originally, when the frame frequency is doubled at a time-series conversion memory 40 in a later stage. The interpolation image signal F1 is generated by using the input image signal F0 and the image signal F2 to perform motion compensated interpolation based on the motion vectors detected by the motion vector detection unit 20. The interpolation image signal F1 is supplied to the temporal emphasis units 30 and 31.

The temporal emphasis unit 30 uses the input image signal F0 and the interpolation image signal F1 to generate an emphasized image signal F0' temporally emphasized and supply the same to the time-series conversion memory 40. The temporal emphasis unit 31 uses the interpolation image signal F1 and the image signal F2 to generate an emphasized image signal F1' temporally emphasized and supply the same to the time-series conversion memory 40.

The emphasized image signal F0' outputted from the temporal emphasis unit 30 and the emphasized image signal F1' outputted from the temporal emphasis unit 31 are simultaneously written in the time-series conversion memory 40 at the first frame frequency.

The time-series conversion memory 40 stores the emphasized image signals F0' and F1' temporarily. The time-series conversion memory 40 outputs the emphasized image signals F1' and F0' to an image gain controller 53 in this order. At this time, the time-series conversion memory 40 outputs the emphasized image signals F1' and F0' at twice the frame frequency of the input image signal F0.

For the convenience of explanation, the input image signal F0 is assumed to be a progressive scan signal having a frame frequency of 60 Hz. It is assumed that NTSC and HDTV signals of the interlace formats are converted into progressive scan signals in advance.

The image gain controller 53 controls amplitudes of the emphasized image signals F0' and F1' supplied from the time-series conversion memory 40. At this time, the image gain controller 53 multiplies the emphasized image signals F0' and F1' by brightness information g as an image control signal S1 supplied from a control operation unit 52. The image gain controller 53 thus adjusts the emphasized image signals F0' and F1'. The image gain controller 53 supplies a liquid crystal driving unit 60 with the emphasized image signals F0' and F1' with the amplitudes adjusted.

A liquid crystal panel 70 is an active matrix-type display panel which includes plural pixels arranged in a matrix and holds an electrical signal at each pixel for a predetermined period of time for display. The liquid crystal driving unit 60 drives the liquid crystal panel 70 so that the liquid crystal panel 70 displays the image signal outputted from the image gain controller 53. The liquid crystal driving unit 60 applies voltages to conductors extending in X and Y-axis directions in the liquid crystal panel 70 to drive a liquid crystal at the intersection of the two conductors and switches each pixel on and off to display the image signal.

The brightness detection unit 51 detects brightness of the input image signal F0. This brightness is a maximum value M of pixel data in each frame of the input image signal F0, for example. The brightness of the input image signal F0 can be the maximum value M of RGB signal in one frame. Moreover, the brightness of the input image signal F0 may be the maximum value of pixel data of plural frames or may be an average of values (pixel levels) of the pixel data in one or plural frames. The brightness of the input image signal F0 may be detected based on a brightness signal, for example, other than the R, G, and B signals or may be statistically detected using a histogram of pixel levels.

In the embodiment, the brightness detection unit 51 detects the brightness of the image signal using the input image signal F0 before the frame frequency is doubled by the time-series conversion memory 40. The brightness detection unit 51 supplies the detected maximum value M of pixel data to the control operation unit 52.

The brightness detection unit 51 may detect the brightness based on an image signal other than the input image signal F0. For example, the brightness may be detected using the image signal F2 outputted from the image memory 10 or using the interpolation image signal F1 outputted from the interpolation image signal generation unit 21. However, given a difference between a time when the brightness is detected by the brightness detection unit 51 (detection system) and a time when control is performed by the control system (the image gain controller 53 and a backlight driving unit 81 and a gain controller 310 which are described later) using the brightness detected by the brightness detection unit 51, it is preferable that the brightness is detected in advance.

Moreover, the brightness detection unit 51 may use a CPU as a means for implementing the control operation to detect the brightness for stabilization of the operation.

The control operation unit 52 generates an image control signal S1 for controlling the image signal and a backlight control signal S2 for controlling a backlight 80 from the maximum value M of the pixel data obtained from the brightness detection unit 51. The image control signal S1 and backlight control signal S2 include the brightness information g. The brightness information g is, for example, 255/M, as the maximum value which can be represented in 8-bit gradation. The image control signal S1 is supplied to the time-series emphasis units 30 and 31 and image gain controller 53. The backlight control signal S2 is supplied to the backlight driving unit 81. The internal operations for the image control signal S2 by the time-series emphasis units 30 and 31 are described later.

The brightness information g as the image control signal S1 is an inverse of the maximum brightness (255/M) in an image obtained by the brightness detection unit 51. Specifically, when the image which is to be displayed on the liquid crystal panel 70 is dark, the brightness information g as the image control signal S1 is large, and the amplitudes of the emphasis image signals F0' and F1' are increased by the image gain control unit 53. When the image to be displayed on the liquid crystal panel 70 is dark, the backlight control signal S2 reduces the intensity of light emitted from the backlight 70. In such a manner, the image signal control signal S1 and backlight control signal S2 include the same brightness information g and operate so that the increase in signal amplitude and the reduction in intensity of light emitted from the backlight 80 are canceled with each other.

The backlight 80 is provided to the back of the liquid crystal panel 70. The backlight 80 projects light onto the back of the liquid crystal display 70. The intensity of light from the backlight 80 is controlled by the backlight driving unit 81. The backlight 80 may be an edge light-type backlight. In this case, the backlight 80 may be provided to the side of the liquid crystal panel 70. The backlight 80 may be located either to the back or side of the liquid crystal panel 70 as long as the backlight 80 can project light onto the back of the liquid crystal panel 70.

The backlight driving unit 81 is supplied with the brightness information g from the control operation unit 52. The backlight 80 controls the brightness (output) of the backlight 80 based on the brightness information g which is generated by the control operation unit 52 based on the brightness of the image signal detected by the brightness detection unit 51.

A description is given of, in such an image display apparatus, a series of processes of the image gain control by the image gain controller 53 and a series of processes of the backlight control by the backlight driving unit 81 after the brightness of the image signal is detected by the brightness detection unit 51.

For example, it is assumed that the maximum value M of the pixel data included in the input image signal F0 is smaller than 255, which is the maximum value that can be expressed in 8-bit gradation ($0<=255<M$). At this time, the brightness information g detected by the brightness detection unit 51 is equal to 255/M.

In this case, the image display apparatus multiplies the image amplitude by g (=255/M) with the image gain controller 53 and multiplies the output of the backlight 80 by 1/g (M/255) with the backlight driving unit 81. Even if the maximum value M of the pixel data included in the input image signal F0 fluctuates, the combination of the output of the backlight 80 and the values of pixel data can keep constant the brightness of the liquid crustal panel 70.

According to the image display apparatus of this embodiment, the smaller the maximum value M of pixel data, the larger the brightness information g, thus setting the output of the backlight 80 lower. Accordingly, the power consumption of the image display apparatus of the embodiment can be reduced.

In the image display apparatus of this embodiment, the amplitude of the image signal outputted from the time-series conversion memory 40 is increased by a factor of g by the image gain controller 53. Accordingly, the voltage applied to the liquid crystal panel 70 becomes g times. For generating the emphasis image signals F0' and F1', the temporal emphasis units 30 and 31 need to temporally emphasize the inputted signal corresponding to the voltage applied to the liquid crystal panel 70. If each of the temporal emphasis units 30 and 31 has the configuration of the temporal emphasis circuit described in PTL1, the degree of the temporal emphasis is not enough to effectively reduce motion picture blurring of the image signal. Accordingly, the temporal emphasis units 30 and 31 are configured as shown in FIG. 2.

Figure 2:
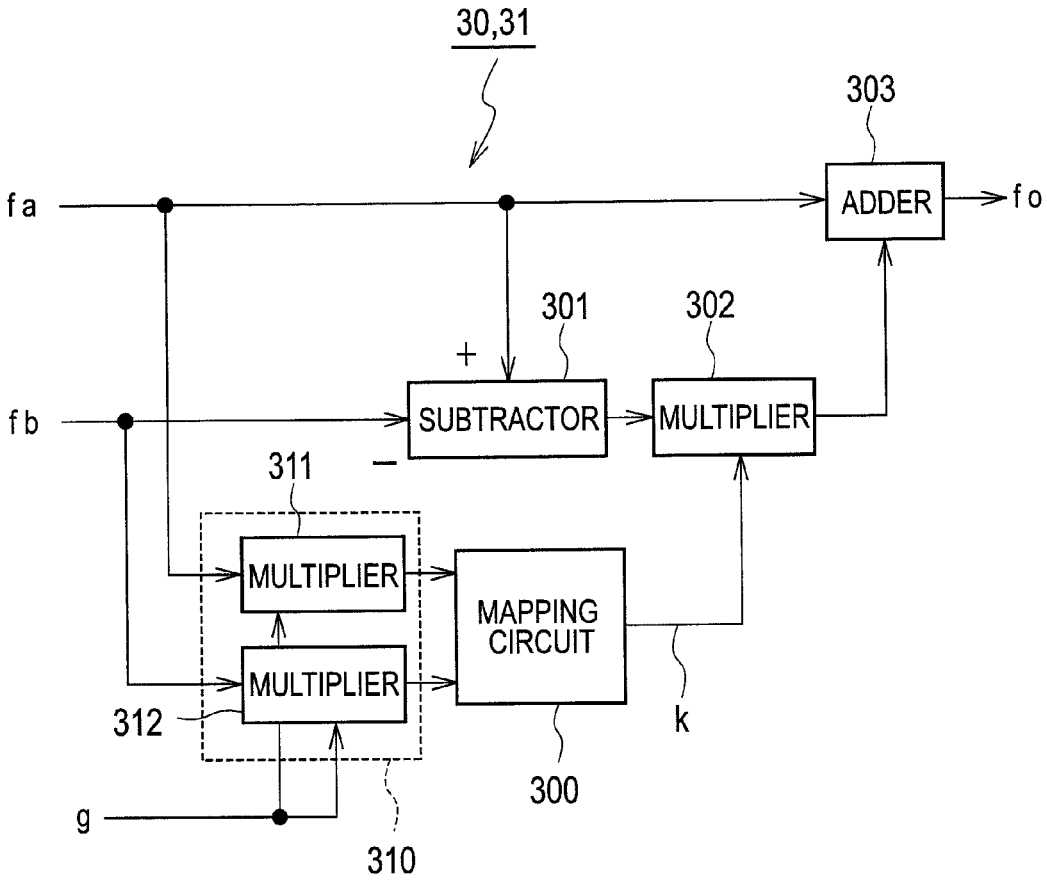
FIG. 2 is a block diagram showing an internal configuration of temporal emphasis units 30 and 31 of FIG. 1.

The temporal emphasis units 30 and 31 configured as shown in FIG. 2 are filters to temporally emphasize image signals. The temporal emphasis unit 30 emphasizes a high temporal frequency component of the input image signal F0 using the interpolation image signal F1. The temporal emphasis unit 31 emphasizes a high temporal frequency component of the interpolation image signal F1 using the image signal F2.

Each of the temporal emphasis units 30 and 31 obtains a temporally emphasized signal Fo expressed by Equation 1 below. fa and fb indicate two types of inputted image signals.

$$Fo=fa+k(fa-fb) \quad \text{(Equation 1)}$$

In Equation 1, k is a gain coefficient to determine the degree to which the image signal is to be emphasized and is set according to the response characteristics of the liquid crystal panel 70. When the liquid crystal panel 70 responds comparatively quickly and causes few afterimages, the gain coefficient k is set small. When the liquid crystal panel 70 responds slowly and causes many afterimages, the gain coefficient k is set large.

As for the relation between the inputted image signal fa and fb, fb is a signal of an image one frame (1/120 s) before fa when it is assumed that the input image signal having a frame frequency of 60 Hz is converted into a signal with a double frequency of 120 Hz by the time-series conversion memory 40 of FIG. 1. To be specific, in the temporal emphasis unit 30, fa is the input image signal F0, and fb is the interpolation image signal F1. In the temporal emphasis unit 31, fa is the interpolation image signal F1, and fb is the image signal F2.

Each of the temporal emphasis units 30 and 31 performing Equation 1 above includes a mapping circuit 300, a subtractor 301, a multiplier 302, an adder 303, and a gain controller 310. The gain controller 310 includes multipliers 311 and 312.

The multiplier 311 of the gain controller 310 multiplies the image signal fa by g, and the multiplier 312 of the gain controller 310 multiplies the image signal fb by g. The g-times image signals fa and fb are supplied to the mapping circuit 300. The mapping circuit 300 generates the gain coefficient k using a conversion table previously set. The conversion table is configured to determine based on the relation between the image signals fa and fb, the strength to perform temporal emphasis. In other words, the mapping circuit 300 functions as a gain coefficient determination unit determining the gain coefficient k indicating the degree to which the high temporal frequency component is to be emphasized.

The subtractor 301 takes a difference between the image signals fa and fb, and then the multiplier 302 multiplies the difference by the gain coefficient k. The adder 303 adds the k-times difference to the image signal fa to output the temporally emphasized signal fo. The subtractor 301 and multiplier 302 function as a high temporal frequency component generation unit which uses the gain coefficient k determined by the mapping circuit 300 to generate a high temporal frequency component which is to be added to the image signal fa.

In such a manner, the temporal emphasis units 30 and 31 adjust the amplitudes of the image signals fa and fb according to the brightness information g and use the image signals faxg and fbxg to determine the gain coefficient k with the mapping circuit 300. The amplitudes of the image signals faxg and fbxg are adjusted by the image gain controller 53 and are made equal to the amplitude of the image signal actually supplied to the liquid crystal driving unit 60.

The gain controller 310 configured to multiply the image signals fa and fb by g performs substantially the same operation as the image gain controller 53 in a later stage. The voltage supplied to the liquid crystal driving unit 60 by the image gain controller 53 can be set equal to the voltage supplied to the mapping circuit 300 by the gain controller 310. Accordingly, the gain coefficient k to be supplied to the multiplier 302 can be set to an appropriate value. In such a manner, by supplying the gain coefficient k having an appropriate value, the temporal emphasis units 30 and 31 can output the emphasized image signals F0' and F1' which are temporally emphasized in consideration that the signal amplitudes are adjusted by the image gain control unit 53 in a later stage.

From the time-series conversion memory 40, an image signal having the frame frequency converted is outputted based on the emphasized image signals F0' and F1'. Also by controlling the image gain based on the brightness information g, the image gain controller 53 can supply an image signal with appropriate brightness (amplitude) to the liquid crystal driving unit 60. Accordingly, the voltage applied to the liquid crystal driving unit 60 has a proper level according to the image signal, and the response characteristics of the liquid crystal panel 70 can be compensated.

As described above, according to an image display apparatus of the first embodiment, temporal emphasis is performed by the temporal emphasis units 30 and 31 using the gain coefficient k for temporal emphasis which is adjusted according to the brightness information g detected by the brightness detection unit 51. According to the image display apparatus of this embodiment, therefore, temporal emphasis can be performed in consideration for the adjustment of the amplitude by the image gain controller 53. Moreover, in the image display apparatus of this embodiment, the frame frequency is doubled by the time-series conversion memory 40. Furthermore, in the image display apparatus of this embodiment, the image gain is adjusted by the image gain controller 53 using the brightness information g, and the output of the backlight 80 is adjusted by the backlight driving unit 81.

In such a manner, according to the image display apparatus of this embodiment, temporal emphasis and conversion to double the frequency are performed after the brightness information g is detected, thus reducing image blurring. According to the image display apparatus of this embodiment, the image gain and the output of the backlight 80 can be adjusted after the brightness information g is detected. This can reduce the power consumption of the backlight 80.

Moreover, according to the image display apparatus of the first embodiment, the frame frequency is doubled after temporal emphasis is performed for the interpolation image signal F1 which is to be interpolated to double the frame frequency and the input image signal F0. Compared with temporal emphasis performed after the frame frequency is doubled, therefore, the image display apparatus has an effect of avoiding the difficulty in implementing the circuit operation due to the increase in operation speed of temporal emphasis while exerting an effect of preventing motion picture blurring. Moreover, the frame memory used by the interpolation image signal generation unit 21 can be shared with the temporal emphasis process. The frame memory can be therefore reduced.

In order to adjust the differences in time when the control operation unit 52 controls the backlight driving unit 81, the multipliers 311 and 312 of the temporal emphasis units 30 and 31, and image gain controller 53, a delay or latch means may be provided. In the brightness detection unit 51, the brightness is calculated from the input image signal of each frame. Accordingly, control of the backlight 80 and image gain controller 53 is delayed by one frame. According to the image display apparatus of the first embodiment, however, the time-series conversion memory 40 causes a frame delay, thus eliminating the difference in time between the detection system (the brightness detection unit 51) and the control system (the image gain controller 53 and backlight driving unit 81 herein). Accordingly, it is not necessary to provide a delay or latch means.

Second Embodiment

Next, a description is given of an image display apparatus of a second embodiment. The same portions thereof as those of the first embodiment are given the same reference numerals, and the description thereof is omitted.

Figure 3:
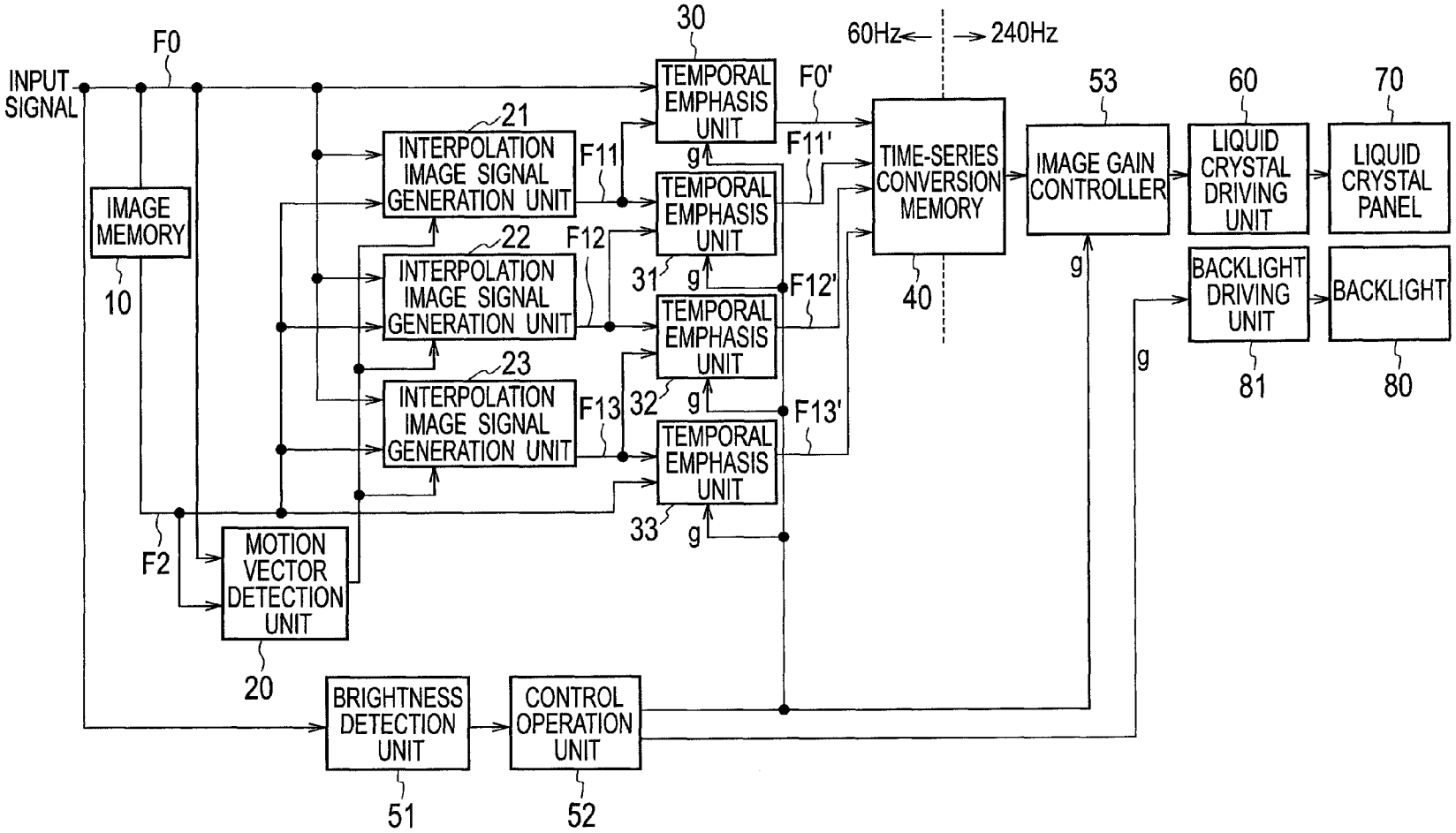
FIG. 3 is a block diagram showing a second embodiment of an image display apparatus of the present invention.

The image display apparatus of the second embodiment is configured as shown in FIG. 3, for example. The image display apparatus of the second embodiment differs from that of the first embodiment in that the frame frequency of the outputted image signal is quadrupled. Accordingly, the image display apparatus of the second embodiment includes three interpolation signal generation units 21 to 23 and four temporal emphasis units 30 to 33.

In order to quadruple the frame frequency, the interpolation image signal generation units 21 to 23 respectively generate interpolation image signals F11, F12, and F13 for three frames which are to be interpolated between adjacent two frames of the input image signal F0 based on the supplied input image signal F0 and the image signal F2 delayed by one frame. In this case, the interpolation image signal generation units 21 to 23 share motion vectors.

The temporal emphasis unit 30 generates a temporally emphasized signal F0' from the input image signal F0 and the interpolation image signal F11. The temporal emphasis unit 31 generates a temporally emphasized signal F11' from the interpolation image signals F11 and F12. The temporal emphasis unit 32 generates a temporally emphasized signal F12' from the interpolation image signals F12 and F13. The temporal emphasis unit 33 generates a temporally emphasized signal F13' from the interpolation image signals F13 and the image signal F2 delayed by one frame.

These temporally emphasized signals F0', F11', F12' and F13' of four frames are inputted into the time-series conversion memory 40. The time-series conversion memory 40 performs time-series conversion so as to generate an image signal having a quadruple frame frequency of 240 Hz. The temporally emphasized signals F13', F12', F11' and F0' are outputted from the time-series conversion memory 40 in this order.

In the image display apparatus of the second embodiment, the temporal emphasis units 30 to 33 are supplied with the brightness information g. The temporal emphasis units 30 to 33 are configured as shown in FIG. 2. Accordingly, each of the temporal emphasis units 30 to 33 multiplies the image signals fa and fb by the brightness information g (255/M) and calculates the gain coefficient k to perform temporal emphasis using the calculated gain coefficient k.

As described above, according to the image display apparatus of the second embodiment, similarly to the first embodiment, the gain coefficient k for temporal emphasis is adjusted according to the brightness information g detected by the brightness detection unit 51, and temporal emphasis is performed by the temporal emphasis units 30 to 33. Moreover, in the image display apparatus of the second embodiment, the frame frequency is increased by a factor of four by the time-series conversion memory 40. Furthermore, in the image display apparatus of the second embodiment, the image gain is adjusted by the image gain controller 53 using the brightness information g while the output of the backlight 80 is adjusted by the backlight driving unit 81.

The second embodiment has a configuration provided with three interpolation image signal generation units and four temporal emphasis units to increase the frame frequency of the image signal by a factor of four, but the frame frequency of the image signal may be increased by a factor of three, five, or more. In such a case, the number of the temporal emphasis units needs to be n (an integer not less than 3) while the number of the interpolation image signal generation units is n−1. In consideration of both the first and second embodiments, the frame frequency of the image signal needs to be increased by a factor of two or more, and the numbers of the temporal emphasis units and the interpolation image signal generation units are n (an integer not less than 2) and n−1, respectively.

The above description is summarized up as follows. The interpolation image signal generation units (21 or 21 to 23) use the first image signal having the first frame frequency and the second image signal obtained by delaying the first frequency by one frame to generate the first to (n−1)-th interpolation image signals which are to be interpolated between adjacent two frames of the first image signal. The first to (n−1)-th interpolation image signals are necessary for producing a frequency n-times higher than the first frame frequency. Herein, n is an integer not less than 2. The first to (n−1)-th interpolation image signals are arranged in reverse chronological order between adjacent two frames of the first image signal.

The temporal emphasis units (30 and 31 or 30 to 33), emphasize the high temporal frequency component of the first image signal and the first to (n−1)-th interpolation image signals. At this time, the temporal emphasis units emphasize the high temporal frequency component of the first image signal using a pair of image signals, the first image signal and the first interpolation image signal. If any one of the first to (n−2)-th interpolation image signals is expressed as i-th interpolation image signal, the temporal emphasis units emphasize the high temporal frequency component of the i-th interpolation image signal using a pair of image signals, the i-th interpolation image signal and the (i+1) interpolation image signal. Herein, i is an integer not less than 1 and not more than (n−2). The temporal emphasis units emphasize the high temporal frequency components of the (n−1)-th interpolation image signal using a pair of image signals, the (n−1)-th interpolation image signal and the second image signal.

Each temporal emphasis unit includes: the first gain controller 310 adjusting the amplitude of each pair of image signals according to the brightness of the image; the gain coefficient determination unit (the mapping circuit 300) determining the gain coefficient representing the degree to which the high temporal frequency component is to be emphasized; and the high temporal frequency component generation unit (the subtractor 301 and multiplier 302) using the gain coefficient to generate a high temporal frequency component which is to be added to each of the first image signal and the first to (n−1)-th interpolation image signals. Accordingly, even if the amplitude is adjusted by the second gain controller (the image gain controller 53) followed by the memory (the time-series conversion memory 40) for frame frequency conversion, the degree of temporal emphasis does not become insufficient, and motion picture blurring of the image signal can be effectively reduced.

As described above, according to the image processing apparatus and method and the image display apparatus and method of the embodiments, it is possible to effectively reduce motion picture blurring of image signals while reducing the power consumption of the backlight.

The aforementioned embodiments are just examples of the present invention. The present invention is not limited by the aforementioned embodiments. It is certain that various modifications can be made, in addition to the above embodiments, according to the design and the like without departing from the technical idea according to the present invention.

What is claimed is:

1. An image processing apparatus comprising:

a brightness detection unit configured to detect image brightness;

a delay unit configured to delay a first image signal having a first frame frequency by one frame to generate a second image signal;

an interpolation image signal generation unit which configured to, by using the first and second image signals, generate first to (n−1)-th interpolation image signals which are to be interpolated between adjacent two frames of the first image signal for providing a frame frequency n-times higher than the first frame frequency (n is an integer not less than 2);

a temporal emphasis unit configured to emphasize a high temporal frequency component of the first image signal using a pair of image signals of the first image signal and the first interpolation image signal, emphasize a high temporal frequency component of the i-th one of the first to (n−2)-th interpolation image signals using a pair of image signals of the i-th interpolation image signal and the (i+1)-th interpolation image signal (i is an integer not less than 1 and not more than n−2), and emphasize the high temporal frequency component of the (n−1)-th interpolation image signal using a pair of image signals of the (n−1)-th interpolation image signal and the second image signal;

a memory into which the first image signal and the first to (n−1)-th interpolation image signals with the high temporal frequency component emphasized by the temporal emphasis unit are written and from which the written the first image signal and the first to (n−1)-th interpolation image signals are read at a second frame frequency which is equal to n times the first frame frequency; and a second gain controller configured to adjust an amplitude of the image signal which is read from the memory and has the second frame frequency according to the image brightness detected by the brightness detection unit, wherein the temporal emphasis unit includes:

a first gain controller configured to adjust amplitudes of each of the pairs of image signals according to the image brightness detected by the brightness detection unit;

a gain coefficient determination unit configured to determine a gain coefficient based on each of the pairs of image signals with the amplitudes adjusted by the first gain controller, the gain coefficient indicating a degree to which the high temporal frequency components of the first image signal and the first to (n−1)-th interpolation image signals are to be emphasized, and a high temporal frequency component generation unit configured to use the gain coefficient determined by the gain coefficient determination unit to generate the high temporal frequency components which are to be individually added to the first image signal and the first to (n−1)-th interpolation image signals.

2. The image processing apparatus according to claim 1, further comprising:

a liquid crystal driving unit configured to drive a liquid crystal panel to display the image signal with the amplitude adjusted by the second gain controller, wherein the first gain controller adjusts the amplitudes of each pair of image signals which are to be supplied to the gain coefficient determination unit to match the amplitudes of the pair of image signals with the amplitude of the image signal supplied by the second gain controller to the liquid crystal driving unit.

3. The image processing apparatus according to claim 1, further comprising:

a backlight driving unit configured to drive a backlight emitting light projected onto the liquid crystal panel, wherein the first and second gain controllers set larger the amplitudes of each pair of image signals or the image signal read from the memory when the image brightness detected by the brightness detection unit is reduced, and the backlight driving unit set lower the intensity of light emitted by the backlight when the image brightness detected by the brightness detection unit is reduced.

4. An image processing method, comprising the steps of:

detecting image brightness;

delaying a first image signal having a first frame frequency by one frame to generate a second image signal;

by using the first and second image signals, generating first to (n−1)-th interpolation image signals which are to be interpolated between adjacent two frames of the first image signal for providing a frame frequency n times higher than the first frame frequency (n is an integer not less than 2);

emphasizing a high temporal frequency component of the first image signal using a pair of image signals of the first image signal and the first interpolation image signal, emphasizing a high temporal frequency component of the i-th one of the first to (n−2)-th interpolation image signals using a pair of image signals of the i-th interpolation image signal and the (i+1)-th interpolation image signal (i is an integer not less than 1 and not more than n−2), and emphasizing the high temporal frequency component of the (n−1)-th interpolation image signal using a pair of image signals of the (n−1)-th interpolation image signal and the second image signal;

writing in a memory, the first image signal and the first to (n−1)-th interpolation image signals with the high temporal frequency component emphasized and reading from the memory, the written the first image signal and the first to (n−1)-th interpolation image signals at a second frame frequency which is equal to n times the first frame frequency;

according to the detected image brightness, adjusting an amplitude of the image signal which is read from the memory and has the second frame frequency, wherein in the step of emphasizing the high temporal frequency components of the first image signal and the first to (n−1)-th interpolation image signals, the image processing method adjusting amplitudes of each pair of image signals according to the detected image brightness;

determining a gain coefficient based on the pair of image signals with the amplitudes adjusted, the gain coefficient indicating a degree to which the high temporal frequency components of the first image signal and the first to (n−1)-th interpolation image signals are to be emphasized, and by using the determined gain coefficient, generating the high temporal frequency components which are to be individually added to the first image signal and the first to (n−1)-th interpolation image signals.

5. The image processing method according to claim 4, further comprising:

driving a liquid crystal panel to display the image signal which is read from the memory and whose amplitude is adjusted; and adjusting the amplitudes of the pair of image signals to match the amplitudes of the pair of image signals with the amplitude of the image signal which is to be displayed on the liquid crystal panel.

6. The image processing method according to claim 4, further comprising:

setting larger the amplitudes of each pair of image signals or the image signal read from the memory when the detected image brightness is reduced, and setting lower the intensity of light projected by the backlight onto the liquid crystal panel when the detected image brightness is reduced.

7. An image display apparatus, comprising:

a first image processing apparatus of claim 1;

a liquid crystal display; and a backlight configured to project light onto the liquid crystal panel.

8. An image display method, comprising the steps of:

detecting image brightness;

delaying a first image signal having a first frame frequency by one frame to generate a second image signal;

by using the first and second image signals, generating first to (n−1)-th interpolation image signals which are to be interpolated between adjacent two frames of the first image signal for providing a frame frequency n times higher than the first frame frequency (n is an integer not less than 2);

emphasizing a high temporal frequency component of the first image signal using a pair of image signals of the first image signal and the first interpolation image signal, emphasizing a high temporal frequency component of the i-th one of the first to (n−2)-th interpolation image signals using a pair of image signals of the i-th interpolation image signal and the (i+1)-th interpolation image signal (i is an integer not less than 1 and not more than n−2), and emphasizing the high temporal frequency component of the (n−1)-th interpolation image signal using a pair of image signals of the (n−1)-th interpolation image signal and the second image signal; and writing in a memory, the first image signal and the first to (n−1)-th interpolation image signals with the high temporal frequency component emphasized and reading from the memory, the written the first image signal and the first to (n−1)-th interpolation image signals at a second frame frequency which is equal to n times the first frame frequency;

adjusting an amplitude of the image signal which is read from the memory and has the second frame frequency according to the detected image brightness;

displaying the image signal having the second frame frequency and the adjusted amplitude on a liquid crystal panel; and for projecting light emitted from a backlight onto the liquid crystal panel, adjusting intensity of the light from the backlight according to the detected image brightness to cancel the adjustment of the amplitude of the image signal having the second frame frequency, in the step of emphasizing the high temporal frequency components of the first image signal and the first to (n−1)-th interpolation image signals, wherein the image display method further comprises:

adjusting amplitudes of each pair of image signals according to the detected image brightness;

determining a gain coefficient based on the pair of image signals with the amplitudes adjusted, the gain coefficient indicating a degree to which the high temporal frequency components of the first image signal and the first to (n−1)-th interpolation image signals are to be emphasized; and generating high temporal frequency components which are to be individually added to the first image signal and the first to (n−1)-th interpolation image signals using the determined gain coefficient.

* * * * *

UNITED STATES PATENT AND TRADEMARK OFFICE

CERTIFICATE OF CORRECTION

PATENT NO. : 8,723,898 B2
APPLICATION NO. : 13/416396
DATED : May 13, 2014
INVENTOR(S) : Hideki Aiba It is certified that error appears in the above-identified patent and that said Letters Patent is hereby corrected as shown below:

In the Claims:
Claim 1, Column 11, Line 31
After "generation unit", delete "which"

Signed and Sealed this
Second Day of September, 2014

Michelle K. Lee

Michelle K. Lee
*Deputy Director of the United States Patent and Trademark Office*